United States Patent [19]

Bendoni et al.

[11] 4,357,091

[45] Nov. 2, 1982

[54] DISPOSABLE FILM PROCESSING KIT

[75] Inventors: Leonard V. Bendoni, Framingham; William L. Hanna, Boston, both of Mass.

[73] Assignee: Polaroid Corporation, Cambridge, Mass.

[21] Appl. No.: 264,571

[22] Filed: May 18, 1981

[51] Int. Cl.[3] ..... G03D 9/02; G03D 5/06

[52] U.S. Cl. ..... 354/304; 354/317; 354/318

[58] Field of Search ..... 354/301, 303, 304, 305, 354/317, 318; 352/130

[56] References Cited

U.S. PATENT DOCUMENTS

| | | | |
|---|---|---|---|
| 2,880,657 | 4/1959 | Bartlett | 95/12 |
| 4,106,042 | 8/1978 | Czumak et al. | 354/317 |
| 4,139,284 | 2/1979 | Stella et al. | 352/130 |
| 4,167,318 | 9/1979 | Wareham | 354/298 |
| 4,200,383 | 4/1980 | Bendoni et al. | 354/304 |
| 4,325,624 | 4/1982 | Pedroli | 354/318 |

OTHER PUBLICATIONS

Research Disclosure, pp. 53 and 54, Jan. 1981, "Processor Apparatus".

*Primary Examiner*—L. T. Hix
*Assistant Examiner*—Alan Mathews
*Attorney, Agent, or Firm*—Alfred E. Corrigan

[57] ABSTRACT

A disposable processing kit for use in developing a photographically exposed roll of instant type film. The kit includes first and second sections which are adapted to mate with each other so as to provide a chamber for enclosing a roll of flexible sheet material such that a free end thereof extends therebetween to the exterior of the kit. The first section includes means for supporting a package containing a supply of viscous processing liquid, a reservoir into which the processing liquid is adapted to flow upon rupturing of the package, and a nozzle for applying a layer of the liquid to one side of the sheet material as the latter is being withdrawn from the kit. The second section includes an integral resilient member which functions to press the sheet material against the nozzle during the spreading of the processing liquid on the sheet material, and to seal the nozzle after the sheet material has been rewound into the chamber thereby substantially sealing off any remainign liquid in the reservoir and the liquid coated sheet material from the exterior of the kit.

6 Claims, 4 Drawing Figures

DISPOSABLE FILM PROCESSING KIT

RELATED APPLICATION

This application relates to an improvement over the disposable processing kit disclosed in application Ser. No. 183,014, filed Sept. 2, 1980, by Walter E. Pedroli, entitled "Self-developing Type Film Processor Kit", and assigned in common herewith, and now U.S. Pat. No. 4,325,624.

BACKGROUND OF THE INVENTION

1. Field of the Invention

This invention relates to a disposable kit for use in developing a roll of instant type film.

2. Description of the Prior Art

The present invention relates to the processing of an exposed roll of instant type film, preferably of the 35 mm transparency type and, more particularly, to a disposable or throw-away kit especially constructed for use in a film processor wherein such film is to be processed so as to produce visible images. It is known that film of the type described above may be photographically exposed in a conventional 35 mm camera and then placed in a processor wherein a liquid is spread across the film so as to initiate the formation of visible images in the film. For example, U.S. Pat. No. 4,167,318 shows a film assemblage wherein a processing composition or liquid is spread between the film's positive layer and its emulsion layer to initiate the formation of visible images in the film. U.S. Pat. No. 4,200,383 describes similar structure except therein the processing liquid is spread between the film and a sheet of transparent material. While the systems in the above patents perform their function, i.e., the production of instant transparencies, the projection of the images could be enhanced if the emulsion layer and the processing liquid were removed from the positive transparency, rather than being an integral part thereof as described in said patents.

U.S. Pat. No. 2,880,657 describes a photographic system wherein a strip of photosensitive material is withdrawn from a cassette, photographically exposed, and then superposed with a strip of image-receiving material immediately subsequent to a processing liquid being deposited between the two strips. The laminate comprised of the two strips and the intermediate layer of processing liquid is then wound upon a rotating drum where it remains until the end of a predetermined processing period, at the end of which the image-receiving strip is peeled from the photosensitive strip and moved past a projection station. However, while this system provides for the processing of a film laminate wherein the emulsion layer is peeled from the image-receiving layer prior to transmitting light through the latter for projection purposes, it does not lend itself to use in a conventional 35 mm camera wherein the entire length of the film is exposed prior to it being processed.

Pages 53 and 54 of the January, 1981 edition of RESEARCH DISCLOSURE disclose three systems for processing a roll of instant type film. Basically, these systems provide for the placement of a film cassette containing an exposed roll of instant type film in a film processor of the type including a processing film dispensing station, a roll of sheet material and a take-up spool upon which the film and sheet material are adapted to be wound with a layer of processing fluid located therebetween. In one of the systems, after the development is completed, the composite of sheet material and film is removed from the spool and peeled apart. It is not known if the emulsion layer of the film is removed during the peeling apart of the film and the sheet material but regardless, this type of processing leaves much to be desired insofar as the sheet material containing the processing fluid must be safely disposed of so as to prevent injury or damage to one or his possessions. The same may be said for the system shown in British Pat. No. 1,121,255 wherein a roller ruptures a container of processing liquid so as to dispense its contents between an exposed photosensitive sheet and an image-receiving sheet as the two are brought into superposition with each other.

From the foregoing, it can be seen that there is a need for a disposable processing kit, which kit not only contains its own supply of processing liquid and a roll of sheet material which is adapted to be superposed with a strip of film during the processing of the latter, but also includes provision for returning the sheet material to the kit after the processing has been completed and sealing the kit so as to safely isolate any residue of the liquid which may remain in the kit or on the sheet material.

SUMMARY OF THE INVENTION

The instant invention relates to a disposable kit which is adapted to be placed in a film processor wherein it will be used in the processing of an exposed roll of self-developing or instant type film. The kit includes a housing consisting of first and second sections which are adapted to be coupled to each other so as to define a chamber for rotatably receiving a roll of flexible sheet material, and a passageway which leads from the chamber, beneath a processing liquid discharge or nozzle, and finally to the exterior of the housing. A first end of the flexible sheet material is attached to a roller located within the chamber and its opposite second end is threaded through the passageway to the exterior of the housing. The second end is secured in place until the sheet material is to be used in the processing of a roll of instant type film, preferably of the 35 mm color transparency type.

The first section of the housing includes an exterior wall upon which a rupturable container of processing liquid is secured with its rupturable end located in communication with a reservoir having the aforementioned discharge or nozzle.

The second section of the housing consists essentially of a substantially planar member having a pair of laterally spaced upstanding extensions for supporting the ends of the roller, and a resilient extension having a pressure pad at its free end, which extension is an integral part of the second section and which extends in a cantilevered fashion from the planar member upwardly into engagement with the sheet material located within the passageway so as to resiliently urge it into engagement with the discharge of the reservoir.

The kit is adapted to be placed within a film processor for use in developing a roll of instant type film. The processor preferably includes a station for receiving and supporting a film cassette containing the roll of exposed film, suitable means for rupturing the container of processing liquid, and a take-up roller to which an end of the exposed film is adapted to be releasably attached. Also, when the kit is located in position within the processor, the securement of the second end of the sheet material is rendered inoperative such that the sheet material may be partially withdrawn from the housing and releasably attached to the take-up roller. A loading door of the processor is then closed to thereby preclude the entry of light into the processor during the development cycle. The container of processing liquid is then ruptured so as to allow the viscous liquid to flow to the discharge or nozzle via the reservoir. After the viscous liquid has had a chance to flow to the discharge, the take-up roller is rotated, preferably by a manually operative crank, in a direction which simultaneously withdraws the sheet material from the kit and the film from its cassette and winds the two in superposition upon the take-up roller with a layer of processing liquid located therebetween; the processing liquid having previously been coated upon a gel coated surface of the sheet material as it was moved past the discharge or nozzle prior to being brought into engagement with the emulsion side of the exposed film. After a predetermined period of time upon the take-up roller, e.g., one minute, the sheet material roller is rotated to withdraw the laminate from the take-up roller. The developed film and the sheet material are stripped from each other as the sheet material is rewound upon its roller. The emulsion or photosensitive layer of the film exhibits a greater adhesion to the sheet material than to the next adjacent layer of the film whereby removal of the sheet material serves to remove the emulsion layer thus increasing the visual acuity and brightness of the resultant positive color transparency and to enhance its stability by virtue of the removal of residual processing liquid in the emulsion layer. In a particularly preferred embodiment of the film, a stripping layer is employed in the film between the emulsion and image receiving layers to facilitate the removal of the emulsion layer. As the sheet material is being returned to the kit, a portion of the first section of the housing may skive a layer of the emulsion and processing liquid residue from the sheet material if the thickness of the returning sheet material-emulsion layer exceeds a predetermined value. When the second end of the sheet material has been withdrawn to a point past the discharge, the resiliency of the integral extension moves the pressure pad into engagement with the discharge so as to seal it, i.e., prevent the passage of any residual processing liquid therethrough. Also, at this time any material skived from the sheet material may now fall onto a portion of the second section which may have been previously treated with a composition for neutralizing the alkalinity of any such material. The processor's loading door is then opened, the developed film cut and mounted for subsequent viewing, and the kit with the spreader sheet and residual processing liquid safely sealed therein removed and discarded.

An object of the invention is to provide a disposable kit of the type adapted for use in a film processor wherein it cooperates with a strip of exposed film to develop visible images therein, which kit is adapted to safely enclose caustic residual products of the development process.

Another object of the invention is to provide a disposable film processing kit of the type described with a unitary member which functions as a pressure pad for urging a sheet against a liquid dispensing nozzle during the beginning of a film processing cycle and as a seal for the nozzle at the end of the film processing cycle.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the invention, reference should be had to the following detailed description taken in conjunction with the accompanying drawings wherein.

DETAILED DESCRIPTION OF THE INVENTION

Figure 1:
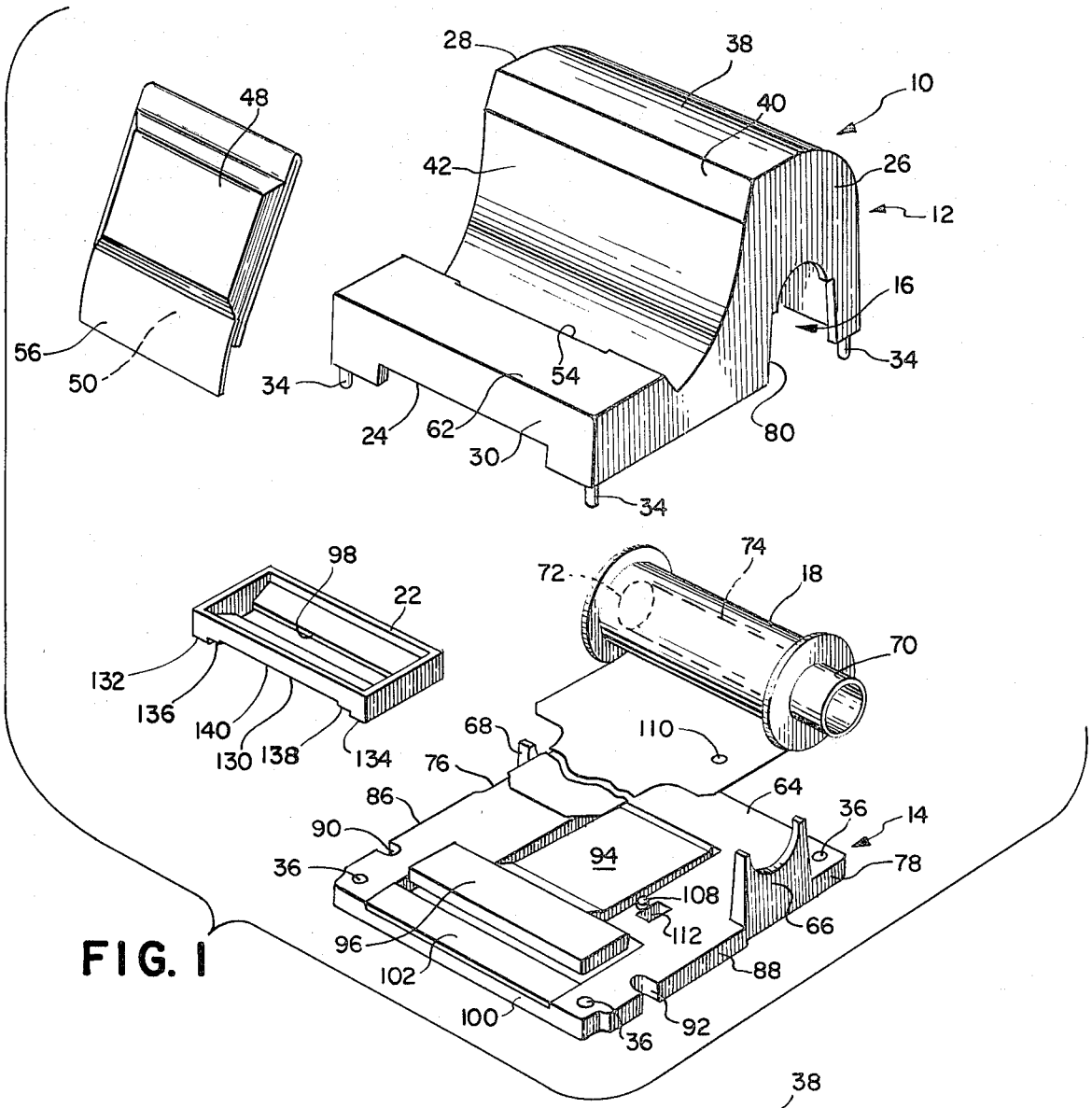
FIG. 1 is an exploded perspective view of a disposable processing kit which comprises the instant invention.
Figure 2:
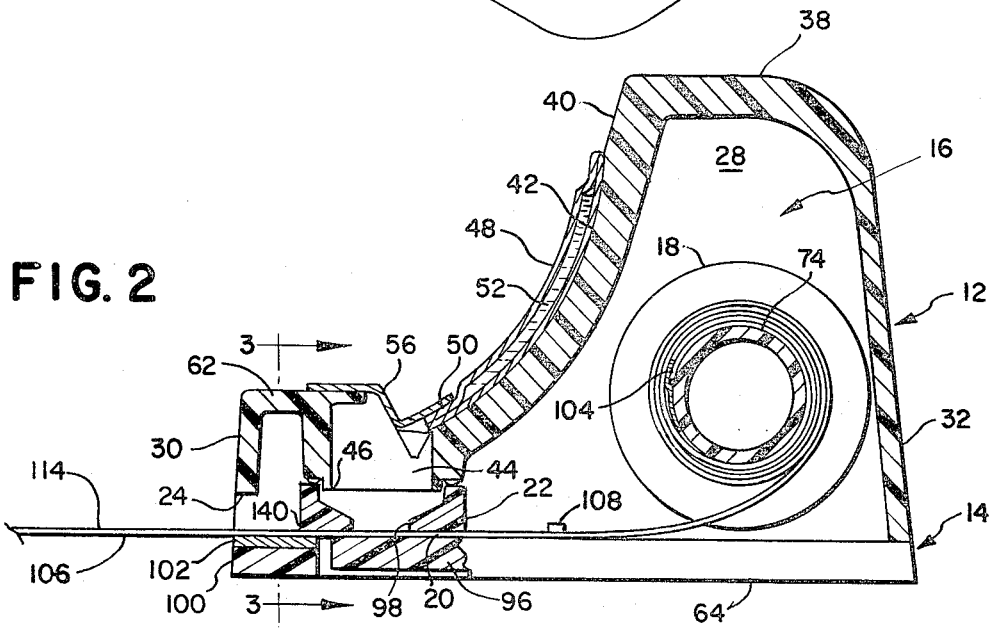
FIG. 2 is an enlarged side elevational view, partly in section, of the disposable processing kit.
Figure 3:
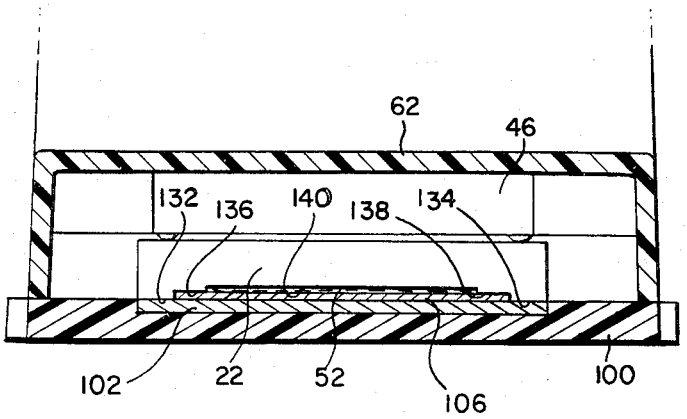
FIG. 3 is an elevational view taken generally along the line 3—3 of FIG. 2.

Reference is now made to the drawings and, in particular, to FIGS. 1 and 2 wherein is shown a disposable film processing kit 10. The kit 10 includes a housing consisting of first and second sections 12 and 14 which cooperate with each other to define (1) a chamber 16 for enclosing a supply of flexible sheet material 18 and (2) a passageway 20 which extends from the chamber 16, beneath a processing liquid discharge or nozzle 22, and finally to the exterior of the kit where it defines an exit slot 24.

The first section 12, which is preferably molded from any suitable plastic material, includes a pair of side walls 26 and 28 interconnected at their ends by a leading end wall 30 having the slot 24 formed therein and a trailing end wall 32. A plurality of pins 34 extend downwardly from the junctures of the walls 26, 28, 30 and 32 and are adapted to be received by and secured within a corresponding number of apertures 36 in the second section. The upper ends of the walls 26, 28, 30 and 32 are interconnected by a top wall 38 having a generally planar section 40 which mergers into a curved section 42. The lower end of the curved section 42 of the top wall 38 terminates at a reservoir 44 which, in turn, is connected at its lower open end 46 to the discharge or nozzle 22. Alternatively, the nozzle 22 may be an integral extension of the reservoir 44.

As best shown in FIG. 2, the curved section 42 of the top wall 38 is adapted to support a container 48 having a rupturable end 50. A supply of a viscous processing liquid 52 is located within the container 48, which supply is at least sufficient to completely coat one side of the sheet material 18 with a layer of a predetermined thickness throughout a major portion of its length. The width of the container 48 is substantially equal to that of an open top 54 of the reservoir 44. The back of the container 48 is provided with a suitable adhesive for securing it to the curved section 42 of the top wall 38. Also, the rupturable end 50 of the container 48 is provided with an apron 56 having an adhesive on one side thereof for securing it to the container 48 and to a section 62 of the top wall 38. Thus, the reservoir 44 is completely sealed at the opening 54.

The second section 14, which is also preferably molded from the same material as the first section 12, consists essentially of a substantially planar member 64 having a pair of laterally spaced upstanding extensions 66 and 68 which are constructed to rotatably support the ends 70 and 72 of a roller 74. It will be noted from FIG. 1 that the extension 68 is spaced inwardly from one side 76 of the planar member while the extension 66 is flush with the opposite side 78. This structural relationship allows the end 72 of the roller 74 to be located wholly within the chamber 16 while the extension 66 cooperates with a slot 80 in the side wall 26 of the first section 12 to define an aperture 82 (see FIG. 4) for allowing the roller end 70 to protrude to the outside of the housing where it may be available to be rotatively driven by a component of a film processor 84. Also, it should be noted that while the sides 76 and 78 are flush with the exterior surfaces of the side walls 28 and 26, respectively, when the two sections 12 and 14 are assembled, as shown in FIG. 2, the remainder of the sides 76 and 78, i.e., at 86 and 88, protrude or extend further outwardly such that locating pins (not shown) in the processor 84 may extend into a pair of locating slots 90 and 92 so as to properly locate the kit 10 within the processor 84.

The second section 14 of the housing further includes a generally T-shaped section 94 which extends upwardly in cantilever fashion from the planar member 64 and is terminated at its free end by a pressure pad 96. The width of the pressure pad 96 (its major dimension) is at least equal to the corresponding dimension of the nozzle 22 while its length is substantially equal to that of an opening 98 in the nozzle 22 to thereby prevent the leakage of any of the processing liquid through the nozzle, as will be explained later. An end 100 of the planar member 64 may be provided with a recess for receiving a pod 102 containing any suitable means for neutralizing any caustic materials that may be skived from the sheet material 18 as it is rewound upon its roller 74.

The sheet material 18 includes a first end 104 which is fixedly attached to the roller 74 and a second end 106 which, as is shown in FIG. 2, is threaded along the passageway 20, beneath the opening 98 in the nozzle 22, and to the exterior of the kit 10 via the exit slot 24. Before use, the second end 106 of the sheet material 18 is maintained in place by a pin 108 which extends upwardly from the planar member 64 and through an aperture 110 in the second end 106 of the sheet material.

Figure 4:
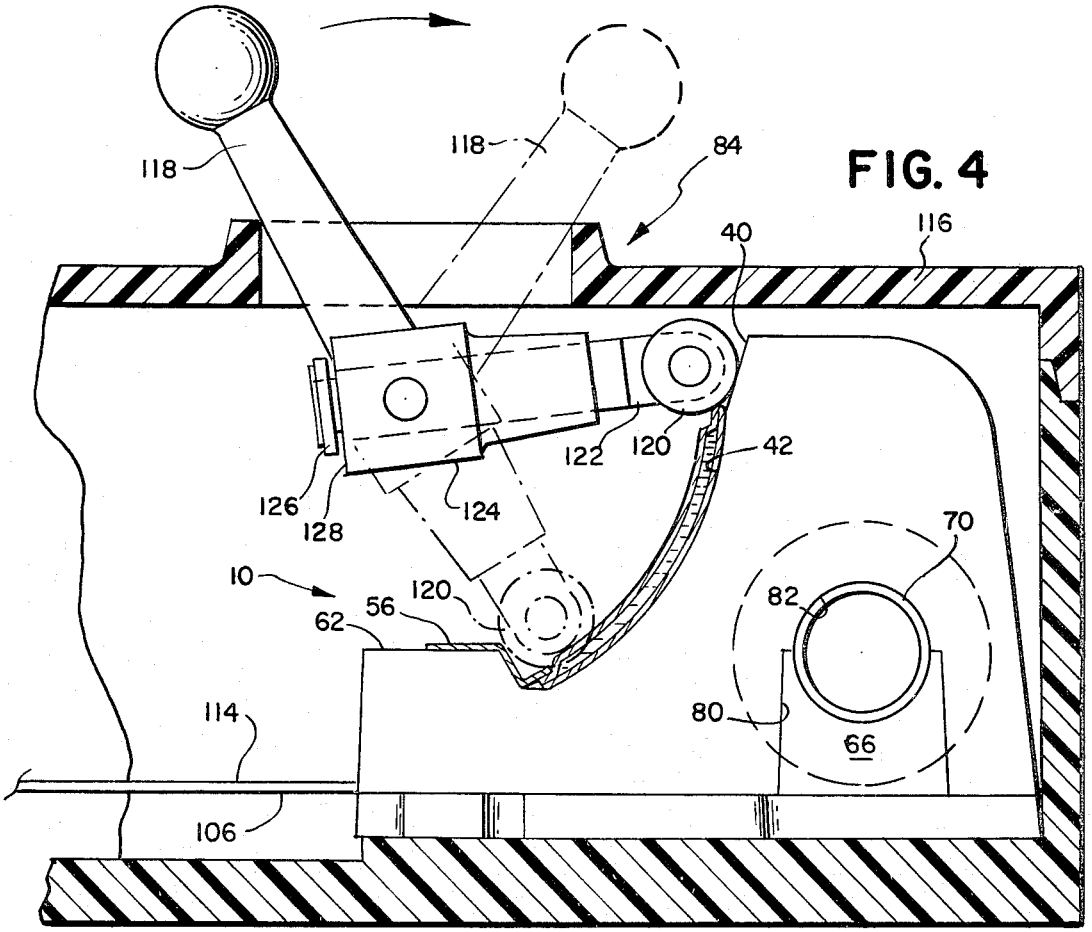
FIG. 4 is a side elevational view, partly in section, of a portion of a film processor in which the kit of the instant invention is adapted to be used.

In use, the kit 10 is adapted to be placed in a film processor 84, part of which is shown in FIG. 4. When the kit 10 is properly located within the processor 84 by the aforementioned pins (not shown) in the processor 84 entering the slots 90 and 96 in the second section 14, a film release pin (not shown) in the processor 84 also enters an aperture 112 in the second section 14 and lifts the sheet material 18 off the pin 108 and maintains it in an elevated position until the sheet material 18 has been fully rewound into the first section 12. Once the second end 106 of the sheet material 18 is free to be withdrawn from the kit 10, it is attached to a take-up roller (not shown) in the processor 84. Also, a 35 mm film cassette containing a roll of exposed 35 mm instant transparency film is loaded into the processor and the exposed film's leader is also attached to the take-up roller such that rotation of the latter will result in the sheet material 18 and the exposed film being wound in superposition thereupon with a gel coated surface 114 of the sheet material 18 facing the photosensitive or emulsion layer of the film. The interior of the processor 84 is then made lighttight by closing its loading door 116. The container 58 is then ruptured by rotating a handle 118 from its solid line position to its broken line position, as shown in FIG. 4, to thereby cause a roller 120 to move from its solid line position to its broken line position thereby rupturing the end 50 of the container 48 while simultaneously causing the viscous processing liquid to flow into the reservoir 44 and the nozzle 22. The journals of the roller 120, which roller has a length at least equal to the width of the container 48, are mounted within bearings located in the free ends of a pair of laterally spaced arms 122 (only one being shown). The arms 122 are reciprocally mounted within a housing 124 which, in turn, is coupled to the handle 118. The movement of each of the arms 122 to the right is limited by an enlarged section 126 of each arm 122, which is located exteriorly of the housing 124, engaging a wall 128 of the housing 124. As best shown in FIG. 4, as the roller 120 is moved from the planar section 40 to the curved section 42 of the top wall 38, it is moved slightly to the left thereby increasing the spring bias on the arms 122 and the roller 120. The take-up roller is then rotated in a direction to simultaneously withdraw the exposed film from its cassette and the sheet material 18 from the kit 10. As the sheet material 18 is being withdrawn, it is guided beneath the nozzle 22 by a pair of laterally spaced shoulders 132 and 134. A second pair of shoulders 136 and 138 overlie the edges of the sheet material 18 and are separated by a recess 130 having a depth of 0.0018 inches which, in turn, is substantially the maximum thickness of the layer of processing liquid 52 which is coated on the gel side 114 of the sheet material 18. The thus coated sheet material 18 is brought into contact with the emulsion side of the exposed film and wound upon the take-up reel as a laminate or sandwich with the coating of processing liquid 52 interposed between the emulsion layer of the film and the gel side 114 of the sheet material 18. The laminate is allowed to remain wound upon the take-up roller for a predetermined period of time, e.g., one minute, at the end of which the development of the latent images in the exposed film has been substantially completed. At this point, the end 70 of the roller 74 is driven in a counterclockwise direction to thereby rewind the sheet material 18 thereupon while simultaneously stripping it from the film as the latter is rewound into its cassette. As the sheet material 18 is stripped from the film, it carries the film's emulsion layer and processing liquid therewith, as described supra. Accordingly, as the sheet material 18 is withdrawn into the kit 10, an edge 140 of the recess 130 skives some of this residue off the sheet material 18 as it passes thereby. After the end 106 passes the edge 140, the residue so skived then falls onto the pad 102 whereat any caustic components thereof are neutralized. Also, the resiliency of the T-shaped section 94 moves the pressure pad 96 into sealing relation with the opening 98 of the discharge or nozzle 22. The kit 10 may then be removed from the processor 84 and discarded with the knowledge that any processing liquid 52 remaining in the reservoir 44 or any skived material are fully contained within the kit 10. One example of a processor in which the instant kit may be used is described in the aforementioned application Ser. No. 183,014.

Since certain changes may be made in the above apparatus without departing from the scope of the invention herein involved, it is intended that all matter contained in the above described or shown in the accompanying drawings shall be interpreted as illustrative and not in a limiting sense.

What is claimed is:

1. A disposable kit for use in a film processor wherein it is adapted for use in the processing of a photographically exposed roll of instant type film, said kit comprising:

a housing comprising first and second sections adapted to be attached to each other so as to define a chamber for enclosing a roll of flexible sheet material and a passageway leading from said chamber to the exterior of said housing;

means defining a reservoir having a discharge which is in communication with said passageway;

a roller having a length of flexible sheet material wound thereupon with a first end secured to said roller and its opposite second end extending through said passageway to the exterior of said housing, said roller being rotatably supported within said chamber;

a supply of processing liquid which is adapted to flow from said reservoir through said discharge and onto one side of said sheet material; and resilient means extending from said second section into engagement with the other side of said sheet material for urging the latter into engagement with said discharge when said sheet material is being withdrawn from said housing and for substantially sealing said discharge after said second end of said sheet material has been rewound into said chamber, whereby any residue from said processing liquid remaining in said reservoir or on said sheet material is substantially enclosed within said housing.

2. A disposable kit as defined in claim 1 wherein said supply of processing liquid includes a container having a rupturable end, said container being secured to said first section with said rupturable end in communication with said reservoir.

3. A disposable kit as defined in claim 1 wherein said second section further includes means engageable with said sheet material for preventing premature withdrawal thereof from said housing.

4. A disposable kit as defined in claim 3 wherein said second section further includes means defining an aperture through which a portion of a film processor is adapted to protrude so as to move said sheet material out of engagement with said engageable means.

5. A disposable kit as defined in claim 1 wherein said resilient means is an integral part of said second section.

6. A disposable kit as defined in claim 1 further including means for skiving said one side of said sheet material upon said sheet material being rewound upon said roller, and means for neutralizing any material so skived.

* * * * *